United States Patent [19]

Zernig et al.

[11] 4,270,240

[45] Jun. 2, 1981

[54] HINGE CUP FOR FURNITURE HINGES

[75] Inventors: Ernst Zernig, Hemer; Willi Pittasch, Herford, both of Fed. Rep. of Germany

[73] Assignee: Richard Heinze GmbH & Co. KG, Herford, Fed. Rep. of Germany

[21] Appl. No.: 931,310

[22] Filed: Aug. 7, 1978

[30] Foreign Application Priority Data

Aug. 19, 1977 [DE] Fed. Rep. of Germany ... 7725760[U]

[51] Int. Cl.[3] ..... E05D 11/00

[52] U.S. Cl. ..... 16/148; 16/163

[58] Field of Search ..... 16/164, 163, 173, 183, 16/165, 128, 159, 148

[56] References Cited

U.S. PATENT DOCUMENTS

| | | | |
|---|---|---|---|
| 3,886,627 | 6/1975 | Bassen | 16/164 X |
| 4,085,481 | 4/1978 | Lautenschlager et al. | 16/159 |
| 4,091,500 | 5/1978 | Lautenschlager | 16/163 X |

FOREIGN PATENT DOCUMENTS

| | | | |
|---|---|---|---|
| 2510259 | 9/1976 | Fed. Rep. of Germany | 16/163 |

*Primary Examiner*—Andrew V. Kundrat

*Attorney, Agent, or Firm*—Thomas R. Morrison

[57] ABSTRACT

A metallic cup shaped insert is anchored within a plastic anchoring piece. The anchoring piece is pressed or hammered into an opening in a furniture panel and, hooking anchoring ribs retain the insert and anchoring part in position in the furniture panel.

4 Claims, 12 Drawing Figures

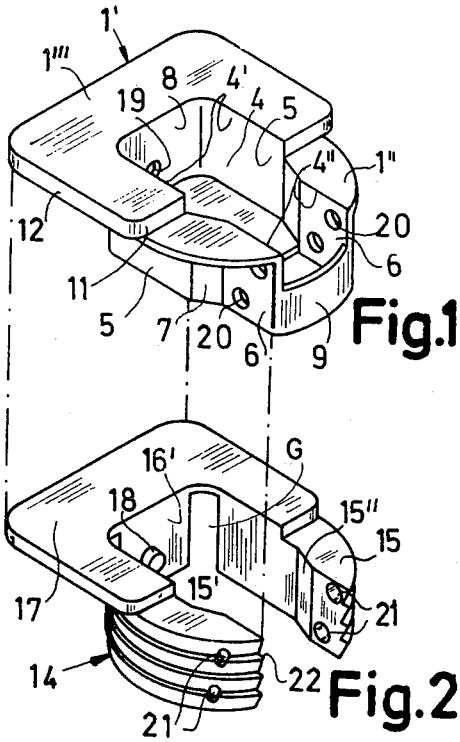
Fig.1
Fig.2
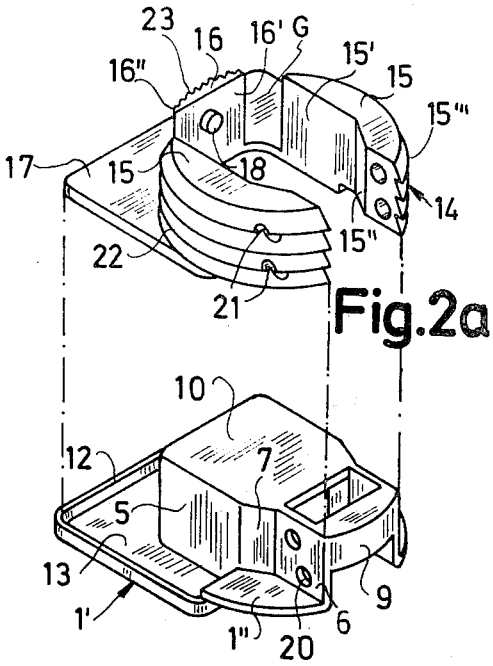
Fig.2a
Fig.1a
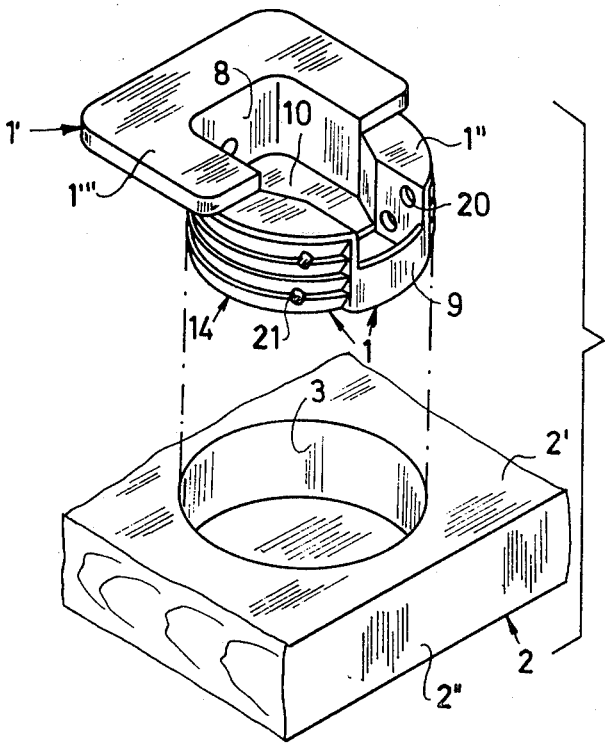
Fig.3

(I-I)

HINGE CUP FOR FURNITURE HINGES

BACKGROUND OF THE INVENTION

The innovation relates to a fitting, especially a hinge cup for furniture hinges, consisting of an insert part made from metal, placed into an opening in the surface of a furniture component, as well as of an anchoring component made from plastic material and arranged around this insert.

Fittings or hinge cups of this kind are known and they ensure the basic advantage that the anchoring component which is subjected to high loading with high force concentration and used, for example, for supporting hinge pins of a furniture hinge, can be made from metal, while the locking part, which is subjected to significantly lower loading and in which no force concentrations occur, can be made from cheaper plastic material. The use of plastic material for the locking part has the additional advantage that, owing to the elastic characteristics of the plastic material, highly efficient anchoring of the anchored components is provided, and hence anchoring of the fitting into a prepared opening or bore in the furniture component is ensured. Also from the appearance point of view the fittings or hinge cups of the above described kind have considerable advantages compared to hinge cups which are made completely from plastic because the insert parts can be designed so that the fitting anchored into the opening or bore of the furniture component ensures that the plastics anchoring component is not visible, so that the overall decorative impression of the fitted fitting is determined only by the insert made from metal, which at least on its visible top surface can be machined better than plastic components, to achieve a corresponding external appearance.

The known fittings, however, have certain disadvantages especially with respect to their anchoring in the prepared openings or bores of the furniture components.

SUMMARY OF THE INVENTION

The objective of the invention is to eliminate these disadvantages and to provides a fitting of the kind described above in which, in spite of low material consumption, it is possible to ensure problem free and reliable anchoring into the opening or bore of the furniture component.

For the solution of this problem a fitting of the kind described above is designed according to the innovation so that the anchoring part consists of at least two separate sections connected with the insert part. This results in an anchoring, with saving especially of plastics material, in which the anchoring forces are concentrated in certain regions of the circumference of the inserted component, preferably to three such regions, by means of which is achieved, from the static loading point of view, an especially favourable and especially also vibration resistant anchoring of the fitting component or of the hinge cup into the prepared bore in a furniture component, for example into a furniture door.

The insert part can be made, in the fitting according to the innovation, either by deep drawing or also by a pressing and bending process from sheet metal, in which the sheet metal component made in this manner is economical and has high strength and its surface can be improved by nickel plating, chromium plating etc.

The sections made from plastic material which form the anchoring part preferably have hook type anchoring ribs on their outside surfaces, so that the fitting can be conveniently anchored by pressing or hammering into the prepared opening or bore of the furniture component. The hooked ribs having elastic deformability as well as being of slightly greater diameter than the opening or bore in the furniture component, are pressed laterally into the material of the furniture component.

In addition the fitting according to the invention has, owing to the separated sections which form the anchoring part, the advantage that there remain regions in the enclosing wall of the opening or bore into which no hooking ribs are pushed. This arrangement ensures anchoring of the fitting or hinge cup in a manner which prevents rotation in the prepared opening or the bore and this effect is significantly improved.

Further embodiments of the innovation are described in the subsidiary claims.

BRIEF DESCRIPTION OF THE DRAWINGS

The innovation is described below in detail by means of the Figures and embodiment example in which:

FIGS. 1 and 1*a* show perspective views of the metal hinge cup or insert part of a furniture hinge in plan view and in rear view;

FIGS. 2 and 2*a* show perspective views of the anchoring component used for fastening of the hinge cup according to FIGS. 1 and 1*a* in front view and rear view;

FIG. 3 is a perspective view of the hinge cup provided with the anchoring component together with a furniture door in part view before the insertion of the hinge cup into the bore of the furniture door;

DETAILED DESCRIPTION OF THE PREFERRED EMBODIMENT

Figure 4:
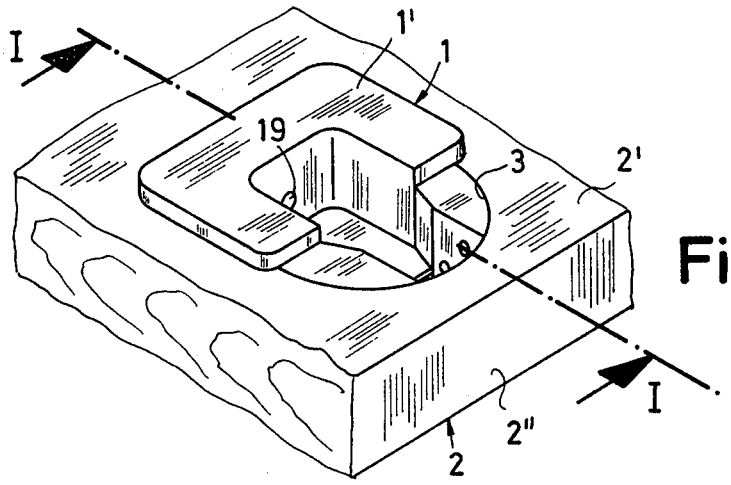
FIG. 4 is a view as in FIG. 3, however, after the insertion of the hinge cup into the hole of the furniture door.

In FIGS. 1–6 item 1 is a hinge cup which is used in a certain manner as the bearing element, for the pivoting axes not shown, on a furniture door 2 and which is to be fastened for this purpose into a hole 3 of the furniture door 2. The hole 3 is a blind hole, i.e. the hole 3 does not pass through the furniture door 2, but is open only on the inner surface 2' of the furniture door 2.

The insert part 1' of the hinge cup 1 is made from sheet metal by deep drawing and it has, in addition to a section which is closed at least partly on its underside and which projects into the hole 3 when the hinge cup 1 is held on the furniture door 2. On the top surface of insert part 1's sideways projecting flange-like sections 1'' and 1''', which are situated on the hinge cup 1 fastened on the furniture door 2 parallel to the inner surface 2' of the furniture door 2.

In the embodiment shown, the insert part 1' has an inner chamber 4, which consists of a region 4' of greater width and of a region 4'' of smaller width, in which these two regions are bounded laterally by the wall sections 5 and 6 which form the enclosing wall of the insert part 1'. On the transition region between the two regions 4' and 4'' the adjacent wall sections 5 and 6, on the sides of the insert part 1', are connected by a third wall section 7 which runs at an angle to the surface of the said wall sections 5 and 6.

In the embodiment shown in FIGS. 1–6 the wall sections 5 and 6, are parallel to each other and parallel to the axis of symmetry S of the hinge cup 1 or the insert part 1'.

As shown especially in FIGS. 1 and 1*a*, the flange shaped section 1''' is C shaped and arranged so that it projects away sideways from the region 4' or from the wall sections 5 as well as sideways away from the inner chamber 4 of the hinge cup and beyond the rear and closing wall section 8. In the embodiment shown, two flange shaped wall sections 1'' are also provided, which project away sideways from the part 1' in the region of the wall sections 6 and 7. The wall sections 6 and 7 are connected to each other at the front end of the insert part 1' by another wall section 9, which also, like the wall section 8, forms part of the enclosing wall of the insert part 1' and it closes the inner chamber 4 of the insert part 1'.

From FIGS. 1 to 3 it can be seen that the flange shaped sections 1'' are closer to the bottom 10 of the part 1' than the flange shaped section 1''', in which there is provided on the transition between the flange shaped sections 1'' and the flange shaped section 1''' at a step 11, which connects the flange shaped sections 1'' with the flange shaped section 1''' and which runs approximately at right angles to the surfaces of sections 1'' and 1'''. The step 11 continues to form an edge 12, which is arranged on the outside circumference of the C shaped flange section 1''' and which forms a depression 13 on the underside of the said flange shaped section.

The hinge cup is fastened in the hole 3 by the anchoring part 14 made from plastic. Anchoring part 14 has three separate sections 15 and 16 which rest against the enclosing wall of the insert part 1'. The two opposite facing sections 15 rest with their inner faces 15' against the outside surface of the wall sections 5,6 and 7 of the insert part 1' on both sides of the axis of symmetry S, while the section 16 rests by its inside face 16' against the outside surfaces of wall section 8 which is at right angles to the axis of symmetry S.

As shown especially by FIGS. 2 and 2*a*, the two sections 15 as well as the section 16 are connected by the web 17 to form an integral unit. This web has C shape in which the surfaces of the web 17 are parallel to the surfaces of the flange shaped section 1''' and the thickness and the width of this web are designed so that the web 17 can be completely accommodated into the depression 13 of the insert part 1'. On the inner face 16' of the section 16 a pin shaped projection 18 is formed, which engagesa hole 19 in the wall section 8. Since, however, the inner surfaces 15' of the sections 15 are matched to the shape of the wall sections 5,6 and 7 in such a manner that the inner surfaces 15', at the end of sections 15 adjacent to the section 16, have greater separating distance between them than that on the ends remote from section 16 and in addition in the region between these two ends is arranged on each inside face 15' a sloping transition section 15'' which is matched to the given wall section 7, hence the anchoring part 14 is reliably anchored at three points in the insert part 1', after the snap fitting of the projection 18 into the bore 19.

The anchoring part 14 is additionally secured to the insert part 1' by the two pivoting axes which are not shown; these axes are parallel to each other and project at right angles to the axis of symmetry S and are held at both ends in bores 20. The bores 20 are arranged into the wall section 6. The pivoting axes have sufficient length to project slightly beyond the outside surface of the wall section 6 and reach into the bores 21 of sections 15 and especially at those ends of each section 15 which are remote from section 8.

While the inner faces 15' and 16' of the sections 15 and 16 are matched to the shape of the enclosing wall of insert part 1' or to the shape of the wall sections 5–8, outside surfaces 15''' or 16'' of the sections 15 and 16 are designed with a circular arc in such a manner that these outside surface 15''' and 16'' form part of a cylindrical enclosing wall, which is interrupted by a gap G between the sections 15 and 16. On the outside surfaces 15''' of the sections 15 are formed hook type anchoring ribs 22, which run parallel to the bottom 10 or to the inner surface 2' of the furniture door 2, while on the outside surface 16'' of the section 16 are moulded ribs 23, which project at right angles to the bottom 10 or at right angles to the inner surface 2' of the furniture door 2.

Figure 5:
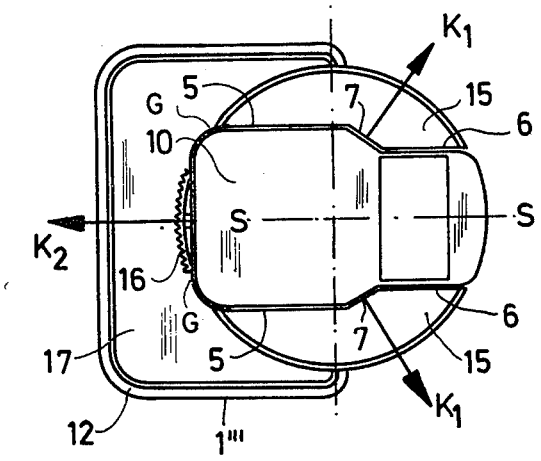
FIG. 5 is a rear view of the hinge cup provided with anchoring components.
Figure 6:
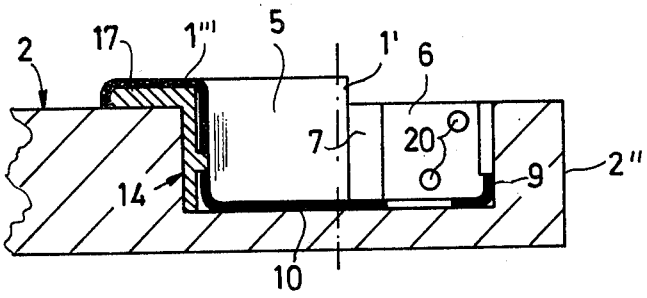
FIG. 6 is a cross section along I—I of FIG. 4.

The hinge cup 1 is fastened into the bore 3 of the furniture door 2 in such a manner that at first the anchoring part 14 is placed on the cup shaped section 1', in which the two sections 15 are in contact on both sides of the axis of symmetry S with the outside surface of the cup shaped section 1' and the section 16 is in contact with the outside surface of the wall section 8, while the web 17 is situated in the depression 13. In this condition the hinge cup 1 can be pushed or hammered into the hole 3, in which the anchoring ribs 22 and the ribs 23 are pushed laterally into the material of the furniture door 2. The anchoring ribs 22 accommodate forces which act at right angles to the inner surface 2' of the furniture door 2, while the ribs 23 secure the hinge cup 1 against undesirable rotation in the bore 3. The wall sections 7 which are at an angle to the axis of symmetry S and which press against the transition sections 15'' of the sections 15 ensure that after the insertion or hammering of the hinge cup 1 into the bore 3 of the furniture door 2, the anchoring forces act at an angle to the axis of symmetry S between the anchoring part 14 and the material of the furniture door 2 as well as between the anchoring part 14 and the insert part 1' in the region of the sections 15, as shown by arrows K1 in FIG. 5. The section 16 ensures anchoring forces between the said section and the material of the furniture door 2 as well as between the said section and the cup shaped section 1' of the hinge cup 1, which acts in the direction of the axis of symmetry S, as shown in FIG. 5 by the arrow K2. Hence this results in an especially favourable and especially also vibration resistant anchoring of hinge cup 1 in the furniture door 2 from a static strength point of view, because the vectors of the anchoring forces K1 and K2 are arranged approximately in the form of an equilateral triangle.

Figure 7:
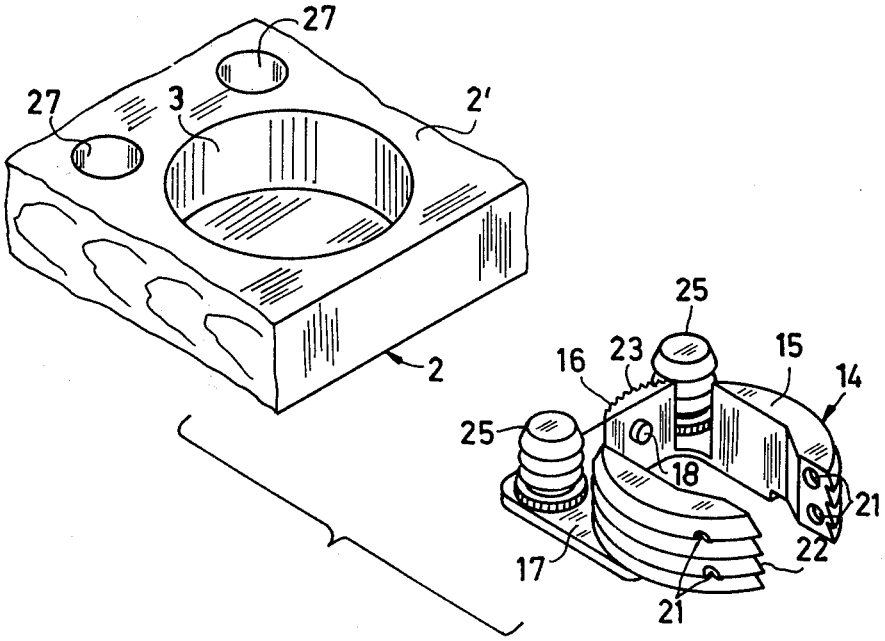
FIG. 7 is a perspective view of an anchoring component as in FIG. 2*a*, however, with additional plug shaped sections.

FIG. 7 shows, in perspective view, an anchoring part 14 which matches the anchoring part 14 of FIGS. 1–6; however, in addition to the sections 15 and 16, it has plug shaped sections 25 formed on the underside of the C shaped web 17 and projecting in the same manner as the sections 15 and 16 at right angles to the underside of the web 17. The anchoring part 14 is used together with the insert part section 1' of FIGS. 1–6, in which, however, in addition to the hole 3, additional holes 27 are provided on the inner surface 2' of the furniture door 2 for receiving the plug shaped sections 25. Plug shaped sections 25 have hooked circumferential ribs 26 for anchoring them in additional holes 27.

Figure 8:
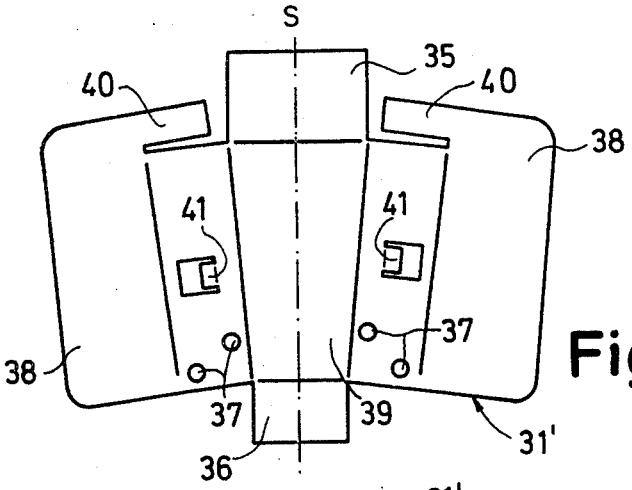
FIG. 8 is a plan view of a blank made from sheet metal for an insert part of another embodiment of the hinge cup according to the invention.
Figure 9:
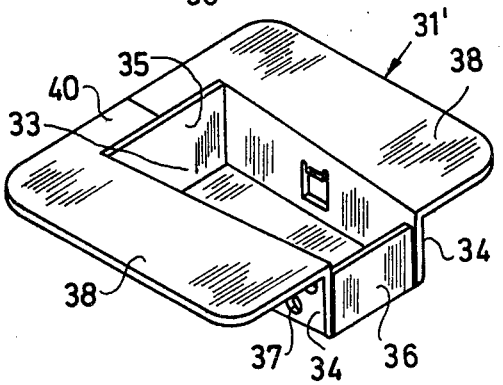
FIG. 9 is a perspective view of the insert part of a hinge cup according to FIG. 8 after its completion.
Figure 10:
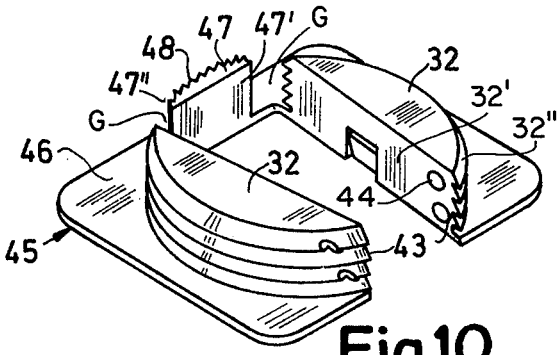
FIG. 10 is a perspective view of the modified embodiment of the anchoring component used with the insert part according to FIG. 9.

FIGS. 8–10 show a hinge cup, which consists of an insert part 31'. In contrast to the insert parts 1' the insert part 31' is not made by deep drawing but by pressing (stamping) and bending from sheet metal. The insert part 31' has an inner chamber 33 of trapezoidal cross section, which is bounded on both sides of the axis of symmetry S by wall sections 34 which are at an angle to this axis of symmetry and it is bounded at the ends by wall sections 35 and 36. In the region of the narrower width of the inner chamber 33 i.e. adjacent to wall section 36, bores 37 are provided in wall sections 34 for supporting two pivot axes, (not shown), and which are at right angles to the axis of symmetry S.

On the wall sections 34 are formed additionally flange shaped sections 38, which, in the completed insert part 31', project laterally away from the wall sections 34 and which are parallel to the floor 39 or parallel to the inner surface 2' of the furniture door 2. Each flange shaped section 38 has, moreover, an extension 40, which projects beyond half the width of the wall section 35 on the rear end of the insert part 31'. In order to be able to anchor the insert part 31' of the hinge cup into the hole 3 of the furniture door, sections 32 which are both made from plastic are provided; the inner face 32' of sections 32 contact the outside faces of the wall sections 34. The inner surfaces 32' also run at an angle to the axis of symmetry S as the said wall sections 34, and they are straight or flat. Each wall section 34 has, moreover, one outward bent or outward pressed plate 41 whose surfaces are parallel to the floor 39 and which engage a rectangular opening 42 (FIG. 10) of the section 32. By means of plate 41 displacement of the sections 32 parallel to the surfaces of the wall sections 34 is prevented. The sections 32 are domed with a circular arc on the outside surfaces 32'' in such a manner that the outside faces 32'' form part of the interrupted cylindrical outside surface of the hinge cup. In addition the sections 32 have on the outside surface 32'', laterally projecting hooking anchoring ribs 43, which run parallel to the floor 39 or parallel to the inner surface 2' of the furniture door 2. Additional anchoring of the sections 32 on the insert part 31' is also ensured by the fact that the pivot axes in this embodiment also have their ends projecting beyond the outside surface of the wall sections 34 with bores 44 of sections 32.

As shown in FIG. 10 the sections 32 of the anchoring component are connected to each other by a C shaped web 46. The anchoring component 45 can be used together with the insert part 31' in which the web 46 contacts a surface under the flange shaped sections 38. Web 46 has moulded thereon a section 47 which rests with its inner surface 47' against the outside surface of the wall section 35 and which has ribs 48 on its outside surface 47'' which project in a direction at right angles to the floor 39 or at right angles to the inside surface 2' of the furniture door 2; these ribs 48, like the ribs 23, ensure a rotation preventing holding of the hinge cups in the hole 3, in which the cup consists of the anchoring components 45 and insert part 31'.

The innovation is described by the above embodiment examples. It is understood that variations of these are possible, without departing from the basic idea of the invention.

Anchoring of the hinge cup 31 in the hole 3 of furniture door 2 is once again carried out in such a manner that the sections 32 with their inner faces 32' are mounted on the insert part 31' and subsequently the hinged cup preassembled in such a manner is pushed or hammered into the hole 3. The inclination of the wall sections 34 ensures here also again a three point anchoring, i.e. the insert part 31' rests with its two sections 32 and also with the outside surface of the end wall section 48 against the enclosing surface of the hole 3, thus ensuring a vibration resisting anchoring for the hinge cup 31. At the same time it is also ensured in the embodiment shown in FIGS. 8–10, by the given orientation of the anchoring forces, in which the enclosing surface of the bore 3 is kept free from fastening forces and this hole is situated adjacent to the end edge 2'' of the furniture door 2 and the weakened part of the enclosing surface is not loaded by fastening forces; this elimination of the fastening forces is also ensured in the above described embodiment examples by means of the anchoring force orientation achieved there.

We claim:

1. A hinge cup fitting for connecting a furniture hinge into a hole in a furniture panel comprising:

anchoring means for fitting into said hole;

a metal insert part;

said anchoring means having at least two separate sections each having an outer peripheral surface and an inner peripheral surface, said outer peripheral surface abutting said hole and having means for anchoring therein, said inner peripheral surface abutting said insert part;

a web connecting said at least two separate sections together into an integral unit;

a flange on said insert part covering said web;

at least one of said at least two separate sections including a projection on its inner peripheral surface; and said metal insert part including at least one hole aligned with said projection, said at least one projection engaging said at least one hole in said metal insert part.

2. A hinge cup fitting according to claim 1; wherein said anchoring means includes three separate sections, two of which are connected together by said web and the third of which is integrally formed on said web, and said third section includes said projection on its inner peripheral surface.

3. A hinge cup fitting according to claim 2; further comprising first bearing holes in said anchoring means aligned with second bearing holes in said insert part, said bearing holes being operable to receive at least one hinge pivot pin, said at least one projection on said third section being positioned from said bearing holes.

4. A hinge cup fitting according to claim 1; wherein said anchoring means is made from plastic material.

* * * * *